United States Patent [19]

Maiers

[11] Patent Number: 4,478,419

[45] Date of Patent: Oct. 23, 1984

[54] FOOTBALL TYPE BOARD GAME

[76] Inventor: Richard D. Maiers, Box 340, R.D. #1, Hazleton, Pa. 18201

[21] Appl. No.: 389,397

[22] Filed: Jun. 17, 1982

[51] Int. Cl.[3] ..... A63F 3/00

[52] U.S. Cl. ..... 273/259

[58] Field of Search ..... 273/258, 242, 243, 260, 273/261, 262, 277, 259, 263, 248, 249, 250, 251, 252, 253; D21/24

[56] References Cited

U.S. PATENT DOCUMENTS

| | | | |
|---|---|---|---|
| 1,780,038 | 10/1930 | Parker | D21/24 X |
| 4,147,360 | 4/1979 | Bailey | 273/261 |

FOREIGN PATENT DOCUMENTS

| | | | |
|---|---|---|---|
| 163928 | 9/1933 | France | 273/242 |
| 1548441 | 7/1979 | United Kingdom | 273/242 |

*Primary Examiner*—Richard C. Pinkham
*Assistant Examiner*—Matthew L. Schneider

[57] ABSTRACT

A football type strategy game for two players having a playing surface and movable pieces made up of an offensive unit which plays in turn against opponent's defensive unit. The offensive unit has a Runner piece and Guard pieces and the defensive unit has Tackle pieces. The playing surface has two sets of spaces and a network of routeways connecting one set of spaces to each other and surrounding the other set of spaces. The Runner moves through certain controlled routeways. Guards and Tackles move along both sets of spaces and control routeways surrounding their resting spaces. One set of spaces has three positions in each space that Guards and Tackles rest on: a central position which allows a piece total control of surrounding routeways and movement to another space and two secondary positions which restrict a piece from further movement and diminish control of routeways surrounding that space. Each routeway can be subject to either Guard and/or Tackle control. The object of the game is for the offensive unit to secure and control routeways and spaces that will enable the Runner to advance towards the opponent's end of the board, each advancement scoring points, while the defensive unit tries to secure routeways and spaces that will restrict movement of opponent's Runner. Play continues until Runner reaches the opponent's end of the board or is captured by the defensive unit.

6 Claims, 13 Drawing Figures

| PERIOD | | | |
|---|---|---|---|
| 1 | 2 | 3 | 4 |
| POINTS | | | |
| 0 | 1 | 2 | 3 | 4 | 5 | 6 | 7 | 8 | 9 |
| 00 | 10 | 20 | 30 | 40 | 50 | 60 |

FOOTBALL TYPE BOARD GAME

FIELD OF INVENTION

This invention relates to a board game, more particularly to a strategy game which I call "Scoozie".

PRIOR ART

Strategy board games, save chess and checker types, inhibit what strategies players can choose by involving the use of dice, cards or some form of chance. Scoozie enables total freedom of strategic plays by eliminating the elements of chance or luck.

It is another common disadvantage that board games, save football types, intend each player to simultaneously play offensively and defensively; Scoozie allots each player an offensive unit and a defensive unit which function at separate intervals during the game, thereby allowing total concentration on one team function. Secondly, football type board games keep strict adherence to football rules, regulations and positions. In addition, the board is commonly designed as a simulated football field. Scoozie incorporates the competitive scoring drives of an offensive unit against the pursuit and penetration of a defensive unit into a game structured by only three playing piece types, limited rules and regulations and played upon a two-dimensional board game designed for 2 distinct passageways that is unlike any football field.

And still another common disadvantage of football type board games is that points are awarded to only one certain level of advancement on the board game. Scoozie awards points to the offensive unit for each and every level of advancement.

OBJECT OF THE INVENTION

It is the object of Scoozie to provide the exciting challenge of outscoring and conquering the opposition by sheer weaponry of one's own wit and intellect.

It is another object of Scoozie to provide a strategy game which is easy to learn, yet complex in the various number of strategic plays.

It is another object of Scoozie to provide a competitive team game played upon a game board with a two-dimensional passageway design.

It is another object of Scoozie to provide a strategy game which exercises concentration and stimulates awareness.

Further objects and advantages of my invention will become apparent from a consideration of the drawings and ensuing description thereof.

DESCRIPTION OF THE PREFERRED EMBODIMENT OF THE INVENTION

Figure 1:
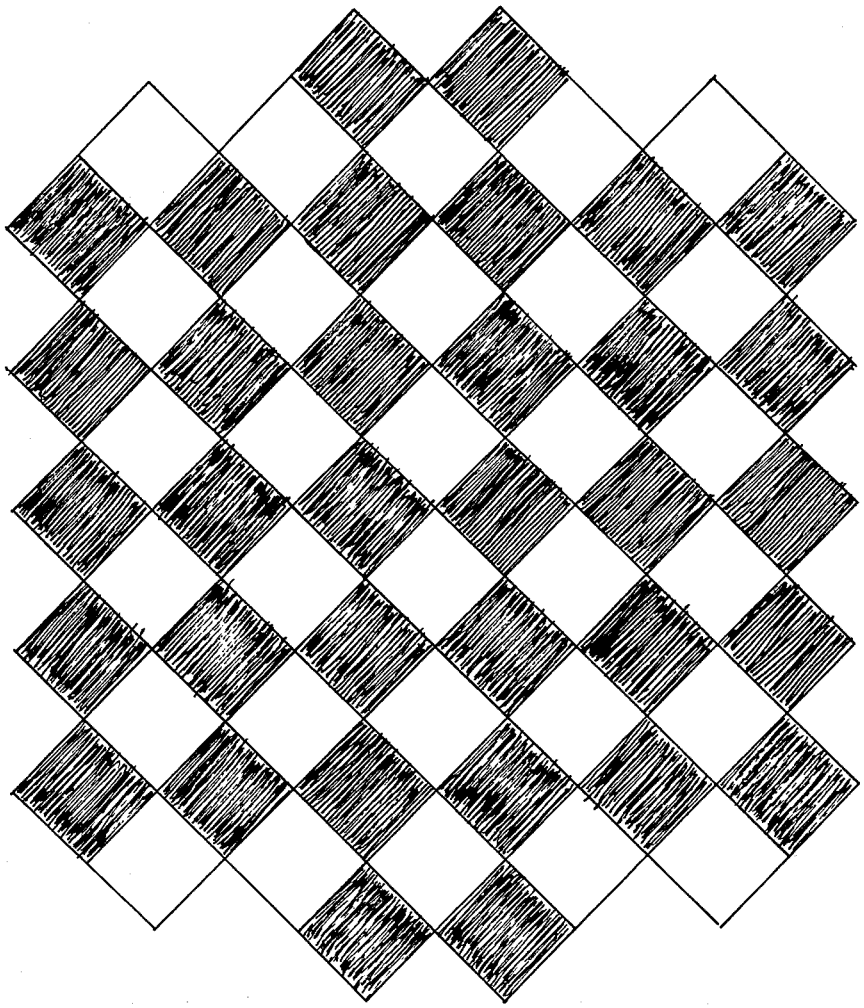
FIG. 1: Background of first pattern

Scoozie is a game for play between 2 players or 2 sets of players and consists of 3 distinct playing piece types and a game board. The 3 playing piece types are called the runner, the guard and the tackle. For purposes of illustration in this application, said pieces are represented by flat, round chips bearing the letter "R", "G", or "T". Said chips with the letter "R" represent the runner. Said chips with the letter "G" represent the guard, and said chips with the letter "T" represent the tackle. The form, dimensions, markings or colorings of said playing piece types are not restricted to or limited by any such specificities other than the following:

(1) Each runner must be identical in form, dimensions and markings and thereby easily discernible from the guard and the tackle.

(2) Each guard must be identical in form, dimensions, markings and colorings, and thereby easily discernible from the runner and the tackle.

(3) Each tackle must be identical in form, dimensions, markings and colorings, and thereby easily discernible from the runner and the guard.

For practical application of the preferred embodiment of Scoozie, there need be:

(1) An offensive unit, used at alternating intervals by both players, comprised of 1 runner and 8 guards, all being of the same colorings, and (2) A defensive unit, used at alternating intervals by both players, comprised of 9 tackles, all being of the same colorings.

For each play of the game, Player #1 will either utilize the offensive unit while Player #2 utilizes the defensive unit; or, Player #1 will utilize the defensive unit while Player #2 utilizes the offensive unit. Therefore, said units are used interchangeably by both players during the entire game.

The game board of Scoozie is preferably a flat, square board measuring approximately 34.6 centimeters×34.6 centimeters. However, the game board can be adjusted to accommodate any shape, including circular, and any other dimensions, whether larger or smaller. Materials used to construct the game board and playing pieces were wood and paper, however, it is to be understood that any other materials suitable for both the game board and playing pieces can be substituted.

The game board contains 2 small scoreboards and a two-dimensional design. The scoreboards are located diagonally across from one another on opposite sides of the board. Each scoreboard is identical and measures approximately 4 centimeters×7.7 centimeters, but not limited to any such dimensions, and consists of two parts: (1) a small top bracket labeled "PERIOD" and divided into 4 columns numbered 1, 2, 3, and 4; such column represent the 4 periods of play, and (2) a larger bottom bracket labeled "POINTS" and divided into 2 rows, the first such row containing 10 separated columns numbered 0 through 9, respectively, and the second such row containing seven separated columns numbered 00, 10, 20, 30, 40, 50 and 60, respectively. Score may be kept by inserting pegs or the like into both rows of the POINTS bracket to indicate the player's cumulative score. Pegs or the like may also be inserted into the PERIOD bracket to indicate the play of the game.

Figure 2:
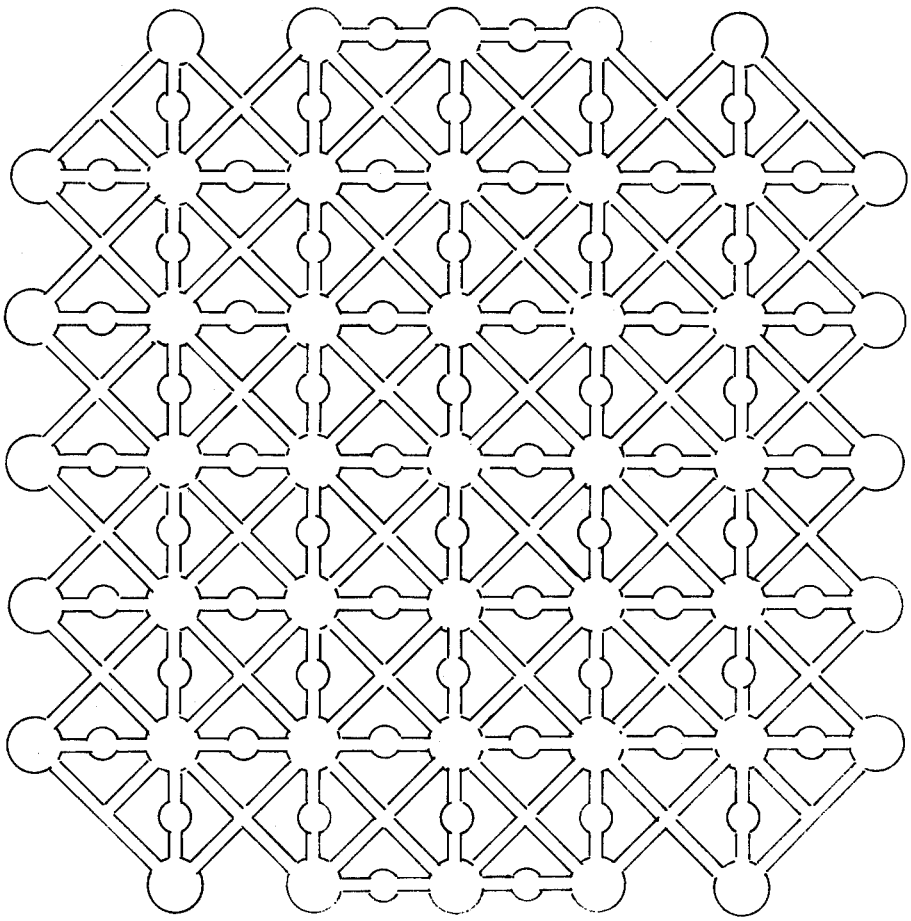
FIG. 2: Second pattern

The two-dimensional design is formed by 2 distinct patterns centrally located upon the game board and measuring approximately 26.6 centimeters×24.3 centimeters. The dimensions of the said design are not limited to or bound by any certain dimensions and can be altered to varying dimensions larger or smaller. The design is symmetrical and is composed of:

(1) A first pattern, illustrated in FIG. 1, containing 13 interlocking horizontal, alternating-colored rows of uniformly shaped spaces which serve as alternative resting spots for guards and tackles. Said uniformly shaped spaces will be referred to and shown as diamond shaped spaces in this application. Whereas the first and last rows contain 2 said spaces, remaining rows alternate in the number of 5 and 6 said spaces, (2) A second pattern, illustrated in FIG. 2, containing 2 different passageways for use by said playing piece types. Said second pattern is comprised of 45 uniformly shaped and spaced figures singly located at an intersection of a plurality of routeways traveling vertically, horizontally and diagonally. Said figures are referred to and shown as geometric circles measuring 1.6 centimeters, though not limited to any such size, and serve as resting spots for the runners. The routeways which form the straight paths between 1 said circle and the next are represented in this application as elongated spaces encased by at least 2 thin lines on opposing sides which are called fronts. Said circles and routeways are a means of travel for the runner(s). Located at midpoint upon each horizontal and vertical routeway are small markings or designations, identical in form and represented in this application by small open circles measuring 0.6 centimeters in diameter, though not limited to any such size. It is on these small circles that guards and tackles travel and rest upon.

Said second pattern is superimposed upon said first pattern in a manner where all diagonal routeways which criss-cross one another overlap and separate said interlocking rows of the said first pattern. Thus the fronts of each diagonal routeway outline and border the exterior boundaries of each diamond shaped space. Simultaneously, one either vertical or horizontal routeway travels centrally across each said diamond shaped space and thereby divides each said diamond shaped space into two symmetrical components. Said symmetrical components are called the freeze zones and in this application are represented by triangular-like shapes. Hence, the joining together of the two said patterns causes each diamond shaped space of the said first pattern to be divided into two equal parts, each of which is outlined by fronts of bordering diagonal and horizontal or diagonal and vertical routeways of the said second pattern.

Figure 3:
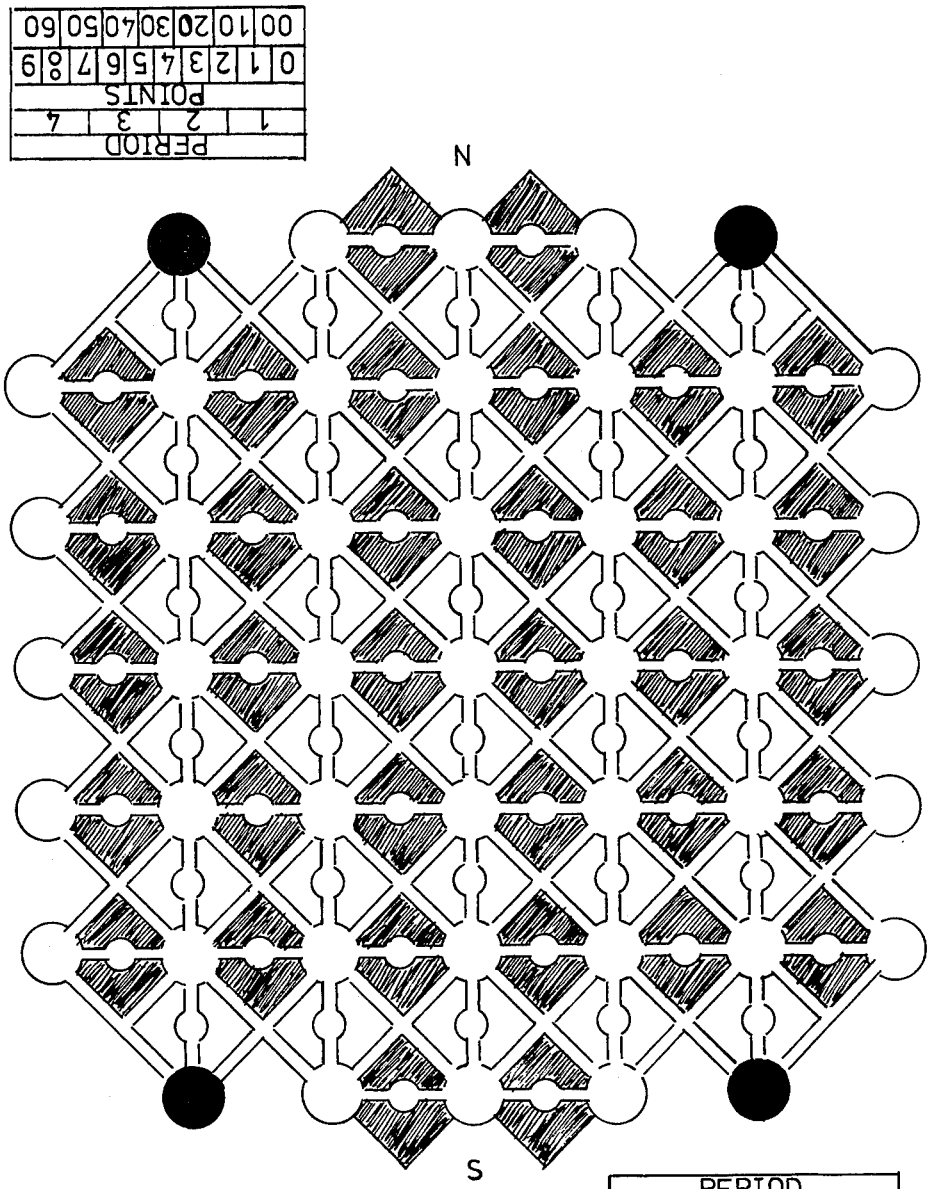
FIG. 3: Perspective view of the game board (6/10 scale)

FIG. 3 illustrates the perspective view of the invention. The game board is so designed that it can be turned upside down and look identical to the view right side up. One scoreboard will always appear in the bottom right-hand corner, while the other scoreboard will be located in the top left-hand corner. For purposes of illustration, the letters "N" and "S" appear directly opposite one another just below the design to denote the 2 opposite sides of the game board. Since Scoozie is usually played between 2 players, one is positioned on the 'south' side of the game board and is directly opposite the second player positioned on the 'north' side of the game board. Each player's scoreboard is then located in their right-hand corner.

There are 7 levels of horizontal routeways and large circles which are called rank. The first such level on both the north and south sides of the game board contains 3 large circles and 2 horizontal routeways joined together plus 2 outer large circles, one on the right and the other on the left which are not connected by horizontal routeways to the first level but are nonetheless located horizontally within the same said level. The 2 said outer circles are designated differently from the outer large circles in the design by a special marking, or by being colored differently as they are in this application. The second level of rank contains 7 large circles and 6 horizontal routeways as does the third, fourth, fifth, and sixth levels or rank. The north side's last level of rank, the seventh, is the south side's first level of rank and vica versa. Therefore, the north side corresponds to the south side in the following manner:

| NORTH SIDE | | SOUTH SIDE |
|---|---|---|
| 1st level of rank | = | 7th level of rank |
| 2nd level of rank | = | 6th level of rank |
| 3rd level of rank | = | 5th level of rank |
| 4th level of rank | = | 4th level of rank |
| 5th level of rank | = | 3rd level of rank |
| 6th level of rank | = | 2nd level of rank |
| 7th level of rank | = | 1st level of rank |

Each level of rank, except the first, is assigned a point value;

| | | | |
|---|---|---|---|
| Level 1 = | 0 points | Level 4 = | 4 points |
| Level 2 = | 1 point | Level 5 = | 6 points |
| Level 3 = | 2 points | Level 6 = | 9 points |
| Level 7 = | 15 points for 3 inner large circles | | |
| | 12 points for 2 outer large circles | | |

While this scoring pattern is considered the fairest arrangement of point values, it is in no way restricted or limited by such scoring increments.

Figure 4:
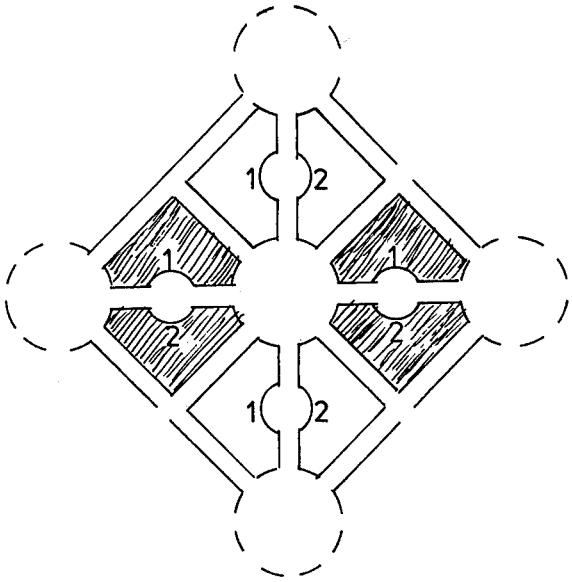
FIG. 4: Sectional view emphasizing horizontal and vertical routeways
Figure 5:
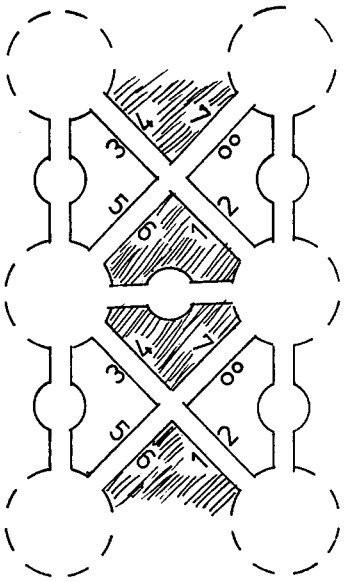
FIG. 5: Sectional view emphasizing diagonal routeways

FIG. 4 illustrates the horizontal and vertical routeways and their respective fronts numbered 1 and 2. Each horizontal and vertical routeway has two fronts. Each horizontal and vertical routeway singly travels across one said diamond shaped space centrally and separates each said space into the two freeze zones. Thus, each said space is then bordered by two fronts centrally, each of which is contiguous to one of its freeze zones FIG. 5 illustrates the diagonal routeways. Diagonal routeways criss-cross one another and in crossing over form a small intersection which divides the routeways into two halves. Each half routeway has two fronts, each of which is contiguous to a different freeze zone. Two half routeways traveling in the same direction form one diagonal routeway containing 4 fronts, each of which is contiguous to a different freeze zone. Every diagonal routeway travels across the boundaries of 4 different diamond shaped spaces and through its four fronts borders 4 different freeze zones. Said four fronts are numbered 1, 2, 3, and 4 for the southeast to northwest diagonal routeways, and 5, 6, 7, and 8 for the southwest to northeast diagonal routeways in FIG. 5. Diagonal routeways travel 1 level of rank up and 1 row of vertical routeways and large circles over.

Figure 6:
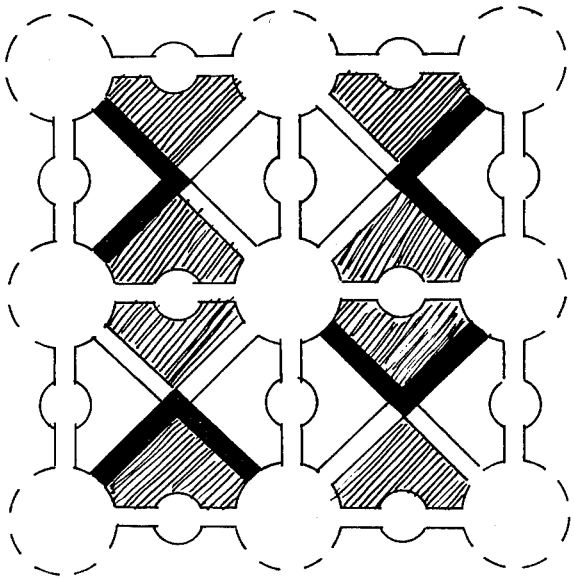
FIG. 6: Sectional view emphasizing improper diagonal routeways

FIG. 6 illustrates the improper use of the diagonal routeways by using a right angle of two perpendicular half routeways instead of a straight path from one large circle to the next. For this preferred embodiment of the invention, it is improper to use a right angle path of two half routeways that travel in different directions as a diagonal routeway. FIG. 6 illustrates 4 improper uses of the half routeways denoted by the solid black routeways.

Hence, a diagonal routeway in this preferred embodiment is:

(1) Composed of 2 half routeways traveling in the same direction, each of which contains two fronts bordering two different freeze zones of two different diamond shaped spaces, and (2) travels one said level of rank up and one said vertical row over.

To facilitate the proper use of diagonal routeways a specific color or colors may be imposed on all diagonal routeways traveling southeast to northwest, and another specific color or colors imposed on all diagonal routeways traveling southwest to northeast. While the invention has been done in black and white, any other colors can be used for the said design, said playing piece types, said scoreboards and remaining outline of the game board itself.

Figure 7:
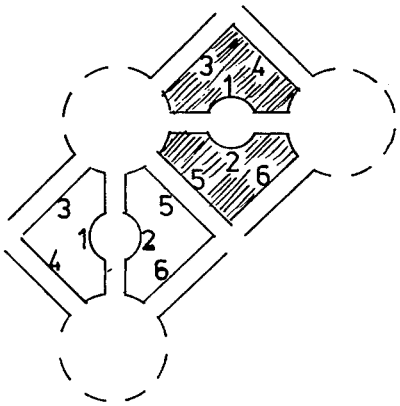
FIG. 7: Sectional view emphasizing the 6 fronts of each said space

FIG. 7 illustrates the six fronts, numbered 1 through 6, which outline the two freeze zones in each diamond shaped space. Four fronts outline the exterior of each diamond shaped space, while the center routeway's two fronts, contained within each said space, complete the outline and thus divides each said space into the two freeze zones. Hence, each freeze zone is bordered by 3 fronts, and there are two freeze zones in each diamond shaped space. Therefore, a total of 6 fronts border each diamond shaped space.

Figure 8:
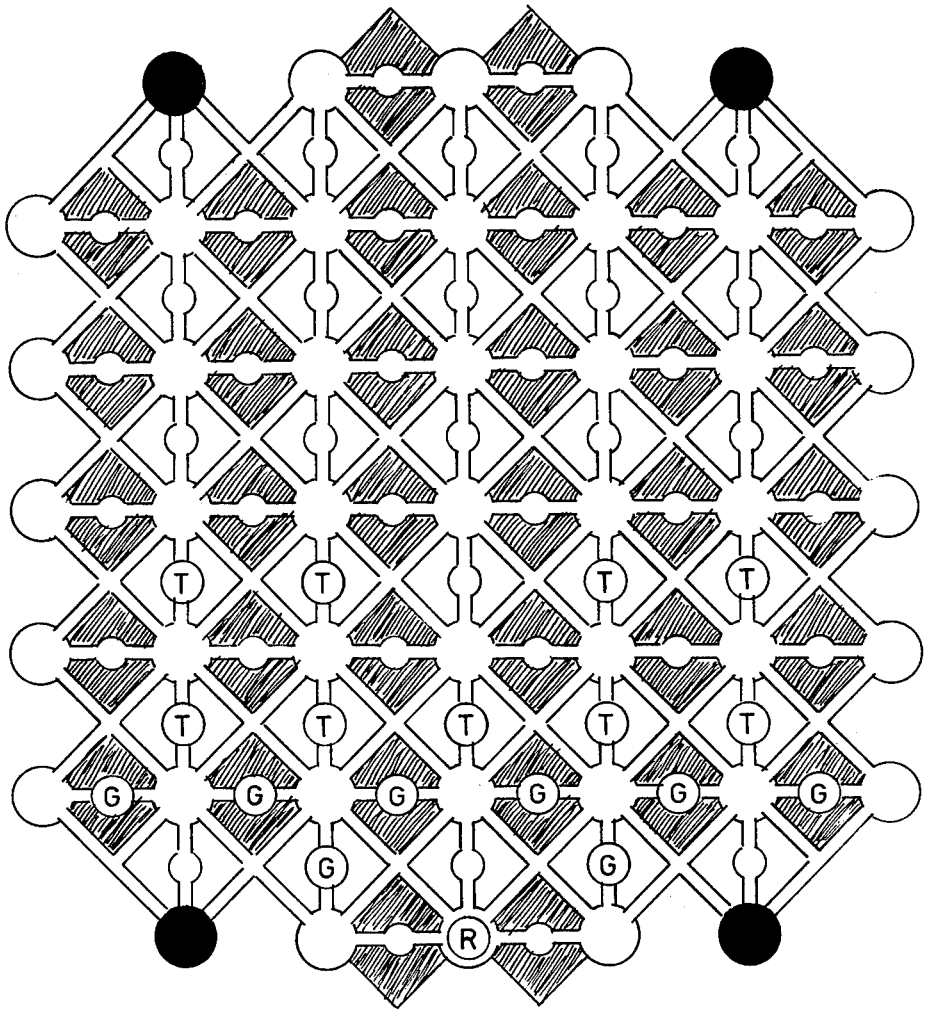
FIG. 8: A starting position (6/10 scale)

FIG. 8 illustrates a starting position showing how the playing pieces are set up. The runner is positioned on the center large circle of the first level of rank. Guards and tackles are positioned upon the small open circles. From this position, guards and tackles establish occupancy of the two contiguous freeze zones and now control the 6 bordering fronts of the same said freeze zones. More specifically, by controlling the two freeze zones and their respective fronts, a guard or tackle partially controls the passageways of the four surrounding diagonal routeways and totally controls the passageway of the center routeway of the same said diamond shaped space.

Figure 9:
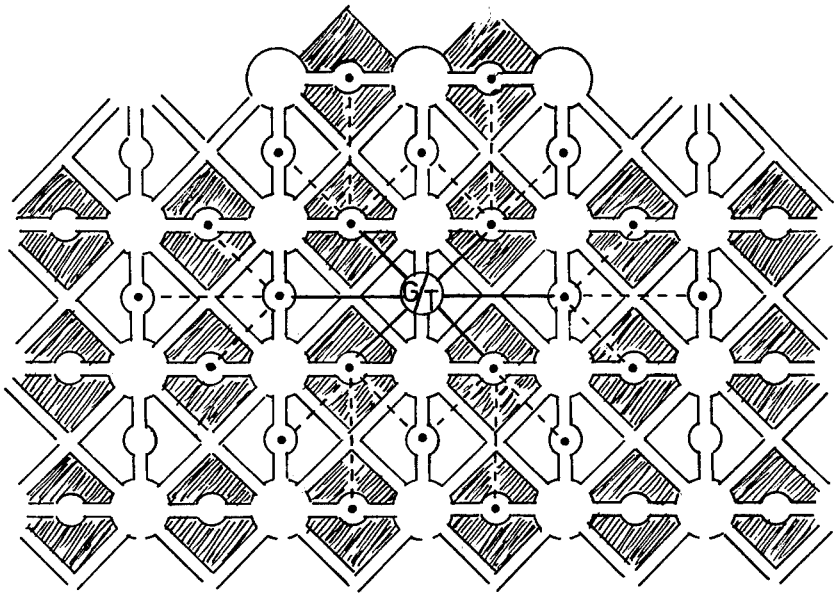
FIG. 9: Guard/tackle movement—vertical starting position (6/10 scale)
Figure 10:
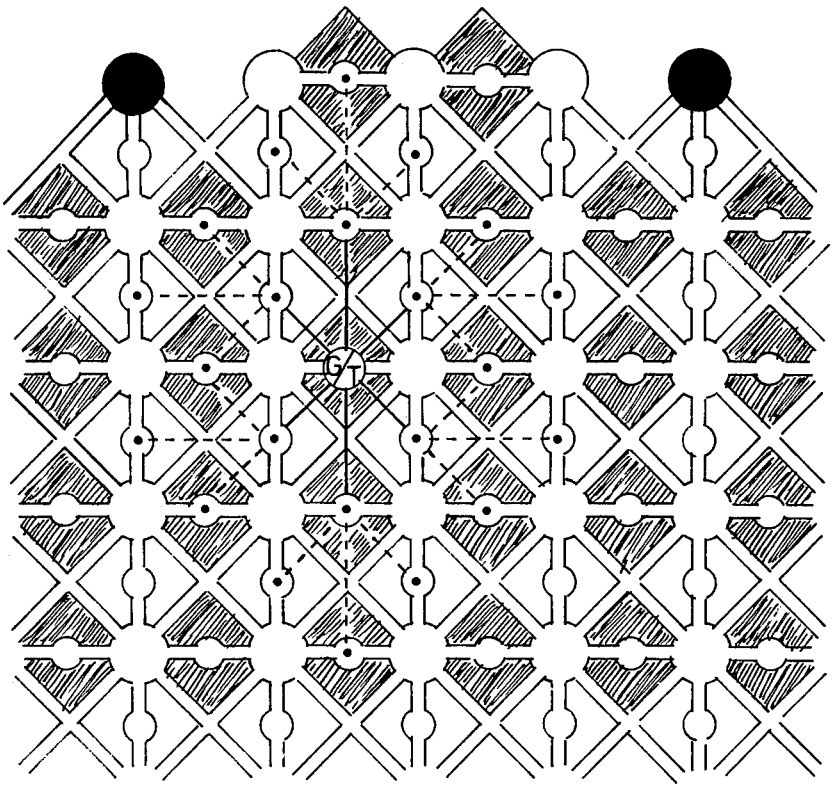
FIG. 10: Guard/tackle movement—horizontal starting position (6/10 scale)

FIGS. 9 and 10 illustrate all possible movements of a guard or tackle, both of which move in the same manner, from both a vertical and horizontal routeway starting position. Guards and tackles move from small circle to small circle moving 1 to 2 spaces each time they are moved. The 1 space movements are illustrated by the solid lines, and the dotted lines represent the 2 space movements in FIGS. 9 and 10. Each small black dot signifies the distance of 1 space. It is to be understood, however, that all movements are made through unoccupied small circles. Guards and tackles can move in any direction except as follows: they cannot jump over each other. More clearly, guards cannot jump over guards or tackles, nor can tackles jump over tackles or guards. Nor can a guard or tackle move directly through any large circle to reach a small circle; guards and tackles can only move around said large circles. Further, guards and tackles cannot, within any 2 space movement, use 1 space to move out of a resting spot and with the second space return back to the same said resting spot. Movement, as applied to guards and tackles, consists of moving a minimum of 1 space or a maximum of 2 spaces, resulting with each moved guard or tackle positioned upon a different small circle resting spot than that occupied prior to being moved.

In addition to moving 1 and 2 spaces, guards and tackles may elect to employ the freeze zone option. The freeze zone option is a special function which permits a guard and a tackle to jointly occupy any 2 freeze zones of the same said diamond shaped space. It is called the freeze zone option because both said pieces become frozen or locked into the same diamond shaped space for the remainder of play. The freeze zone option is exercised primarily for 2 reasons: (1) To stop an opposing piece from further movement and (2) to gain permanent—i.e., for the duration of 1 play—control of a desired freeze zone and its contiguous fronts and thus have partial control of the three bordering routeways. Guards cannot freeze guards nor can tackles freeze tackles. By using a 1 or 2 space movement, a guard or tackle enters into an opponent's occupied small circle which immediately causes the opponent to relinquish the center resting spot and surrender control of the two freeze zones. The invading piece now chooses which freeze zone to occupy and thereby forces the opponent to occupy the remaining freeze zone of the same said diamond shaped space.

Figure 11:
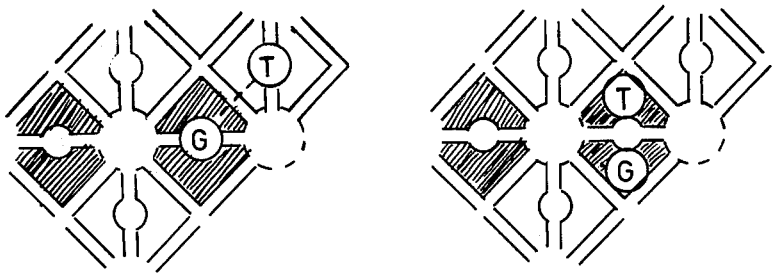
FIG. 11: Freeze zone option (6/10 scale)

FIG. 11 demonstrates one example of the freeze zone option. In this example, the tackle chooses to employ the freeze zone option and therefore:

(1) The tackle uses a 1 space move to enter into the guard's occupied space causing the guard to lose possession of the center resting spot and surrender control of the two contingent freeze zones, (2) The tackle chooses to occupy the top freeze zone and thereby forces the guard to occupy the remaining bottom freeze zone of the same said diamond shaped space, (3) Both said pieces are now frozen into this position for the remainder of the play, (4) Both said pieces now have 'permanent' control of the three fronts contingent upon their respective freeze zones for the remainder of play.

Similarly, the guard could have initiated the freeze zone option and invaded the tackle's resting spot causing the tackle to surrender control of the two freeze zones, thus giving the guard the first choice of which freeze zone to occupy while forcing the tackle to occupy the remaining freeze zone. Diamond shaped spaces having a vertical center routeway have a right and left freeze zone. Diamond shaped spaces having a horizontal center routeway have a top and bottom freeze zone. Whenever the freeze zone option is in effect, however, the center routeway is jointly controlled by the guard and tackle.

Figure 12:
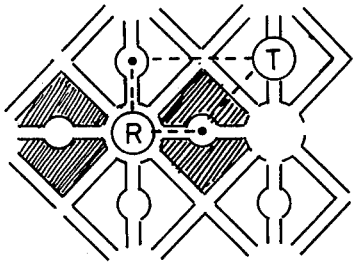
FIG. 12: Capture of the runner (6/10 scale)

FIG. 12 illustrates the additional function a tackle has for capturing the runner. To capture the runner, a tackle must be able to reach the runner's resting spot within the same movement. Entering directly into the runner's resting spot is considered a 1 space movement. Therefore using a 2 space movement, a tackle can only move 1 space to another small circle, as in FIG. 12, and use the second space to move directly into the runner's resting spot and capture the runner. In FIG. 12 the tackle can move 1 space horizontally or 1 space diagonally to the left. From either position, the tackle can then enter directly into the runner's resting spot and capture the runner. The only time a tackle can enter into a large circle is to capture the runner within the same movement. Thus, capture can occur only when a tackle can reach the runner's resting spot in the same movement, with entrance into the resting spot included as 1 space of a 2 space movement or the entire 1 space movement.

Figure 13:
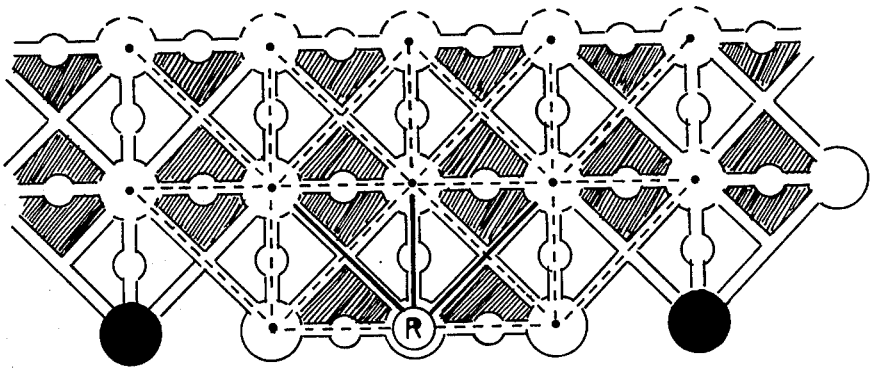
FIG. 13: Movement of the runner (6/10 scale)

FIG. 13 illustrates all possible movements of the runner. The runner moves via the said second pattern from large circle to large circle through straight paths of vertical, horizontal or diagonal routeways whose fronts must be entirely free and clear of any tackle control. Each time it is moved, the runner can travel through 1 or 2 routeways but must always advance in rank at least one level. The solid lines denote the 1 routeway movements and the dotted lines denote the 2 routeway movements in FIG. 13, with the small black dots signifying the distance of 1 routeway. The runner cannot move backwards or use a movement of only horizontal routeways as neither of these movements would advance the runner in rank. Therefore, a 1 routeway movement can only be through a vertical or diagonal routeway. In a 1 routeway movement, the runner moves out of its present resting spot, passes through the routeway and then comes to rest at the adjoining large circle of the next intersection. In a 2 routeway movement, the runner can use a horizontal routeway in combination with a vertical or diagonal routeway; or use 2 vertical routeways, or 2 diagonal routeways, or a combination thereof. In a 2 routeway movement, the runner moves out of its present resting spot, passes through the first routeway and continues directly through the adjoining large circle and intersection onto the second routeway and comes to rest at the next adjoining large circle of the next intersection. Movement, as applied to the runner, consists of moving a minimum of 1 routeway or a maximum of 2 routeways resulting in the runner advancing in rank at least one said level.

The runner can never use routeways whose fronts are partially or entirely controlled by tackles. However, the runner can use routeways whose fronts are controlled by guards. Refering back to FIG. 11, in the diamond shaped space where the freeze zone option is in effect, the center routeway is controlled by both the guard and the tackle; thus, the runner could not travel through said routeway due to the tackle's control even though the guard partially controls the same said routeway. Hence, the runner can use only those routeways whose fronts are contingent upon unoccupied freeze zones, or controlled by guards or a combination thereof.

OPERATION OF THE PREFERRED EMBODIMENT OF THE INVENTION

The game of Scoozie is played between 2 players or 2 sets of 2 players with both of the sets of players or single players representing a team. Each team consists of an offensive unit composed of 1 runner and 8 guards, and a defensive unit composed of 9 tackles. The offensive unit of tone team plays against the defensive unit of the other team and vica versa.

The runner is the only piece that can score points. Points are scored for each and every level of rank that the runner ascends to. The higher the rank, the more points scored. The offensive unit must formulate strategies which will enable the runner to succeed across the board and advance in rank ultimately to the seventh said level. The guards aid the runner by blocking and/or freezing the tackles, and thereby controlling the fronts of routeways needed by the runner for passageways.

The defensive unit must prevent the runner from advancing and thus devise strategies which will enable the tackles to capture or trap the runner. The tackles accomplish this by freezing the guards, setting up blockades that prevent the runner from passage, or thirdly, by directly attacking the runner.

The objectives of the game are two: (1) To score as many points as possible by advancing the runner in rank with the aid of the guards, and (2) to prevent the opponent's offensive unit from scoring little or no points via the defensive unit's strategies.

To begin the game, the players choose a starting position and set up their units accordingly. Players arbitrarily decide who will begin as the offense unit, and that player will be positioned behind the offensive unit; the defensive player is positioned behind the defensive unit. Assuming Player #1 is the offensive unit and Player #2 is the defensive unit, play would go as follows:

The offensive unit always moves first. Each player's turn is the movement of 2 playing pieces. The movement of each said piece is a minimum of 1 space (or routeway for the runner) or a maximum of 2 spaces (or routeways), or a combination thereof. Therefore, Player #1 can elect to move either 1 guard and the runner, or 2 guards. When Player #1 has done so, it is then Player #2's turn to move 2 tackles. When this is completed, it reverts back to Player #1's turn and play continues in this manner unless or until all but 1 tackle and the runner remain the only two playing pieces which are not 'frozen' and thus can move freely on the board. Hence, each player's turn would then be limited to the movement of the remaining piece. Play is ended when one of two things occur:

(1) The runner is captured or trapped and thus cannot advance in rank, or (2) The runner succeeds to the opposite end of the board to the seventh level and scores 12 or 15 points.

At this point, players exchange units, and Player #1 is now the defensive unit and Player #2 is the offensive unit. The players set up their units again in a starting position, but on the opposite side of the board so that the runner is now positioned nearest Player #2.

Scoozie consists of 4 periods of play. Each period consists of two plays. Therefore each player has 1 play offensively and 1 play defensively for each period. Players can keep their own cumulative score tabulated on their respective scoreboards. Conclusively, each player has four plays as the offensive unit and four plays as the defensive unit per game. The player with the highest score tallied from all 4 periods of play is the winner.

While the above speculation contains many specificities, these should not be misconstrued as limitations on the scope of the invention, but rather as an exemplification of 1 preferred embodiment thereof. It is to be understood that numerous variations may be incorporated into the rules and operation of the invention such as initiating various starting positions, increasing or decreasing the number of runners, guards and/or tackles, or expanding or limiting the prescribed movements and functions to form other embodiments of the invention.

In addition, the said design along with said dimensions can be incorporated into other various patterns of 2 distinct passageways composed of variform figures, shapes, routeways and fronts which would similarly produce a two-dimensional patterned game board design utilized by the said three playing piece types to travel and compete upon.

Accordingly, the scope of the invention should be determined not by the embodiment illustrated, but by the appended claims and their legal equivalents.

I claim:

1. Game apparatus for playing a game between two opponents, comprising: a playing surface having a plurality of two different sets of spaces and a network of routeways, said two different sets of spaces comprising: a first set of spaces arranged in an array of non touching rows and columns, a second set of spaces located between said spaces of said first set, said second set of spaces having the borders of four of said second set of spaces located diagonally between said columns of said first set of spaces, all said spaces being available resting areas for playing pieces, and each said second set space having three separate resting area means, one central resting area means located and marked directly in the center of said second set of spaces so as to enable a landing place for playing pieces and two secondary resting area means located and marked on opposite sides of said central resting area means so as to enable captured playing pieces to remain stationed and usable on said playing surface, and said network of routeways connecting said first set of spaces to each other vertically between said rows, horizontally between said columns and diagonally one said row up one said column to the right and one said row up one said column to the left, said vertical routeways dividing in half said second set of spaces so as to enable passage through said second set of spaces located between said rows, said horizontal routeways dividing in half said second set of spaces so as to enable passage through said second set of spaces located between said columns, said diagonal routeways being longest in length, crisscrossing each other perpendicularly and passing along the borders of four of said second set of spaces so as to enable passage through said four bordering spaces located diagonally between said columns, and unique opposing sets of playing pieces being different in men and power than each other, one set using said playing surface means so as to enable advancement of certain playing pieces, with the opposing set using said playing surface means so as to enable capturing of the opposing set.

2. Apparatus as claimed in claim 1, wherein said second set of spaces located between said rows comprise one said secondary resting area means to the left and one to the right of said central resting area means, said second set of spaces located between said columns having one said secondary resting area means located to the top and one said secondary resting area means located to the bottom of said central resting area means, whereby said central resting area means provides a landing place for playing pieces and said secondary resting area means provide places for captured opposing pieces to remain stationed and usable on said playing surface.

3. Apparatus as claimed in claim 1, wherein said vertical routeways further divide said central resting area means in half and make up the innermost borders of said secondary resting area means located in each of said second set of spaces, said horizontal routeways further divide said central resting area means in half and make up the innermost borders of said secondary resting area means located in said second set of spaces, said diagonal routeways make up the outermost borders of four of said secondary resting area means, whereby said routeways provide a means for enabling passage through said second set of spaces, each said vertical and horizontal routeway passing through one of said second set of spaces, and each said diagonal routeway passing through four of said bordering second set of spaces.

4. Apparatus as claimed in claim 1, wherein said playing surface allows for two types of passageway means for playing piece movement, one passageway means having an array of two said sets of adjacent spaces arranged between each other in rows and columns so as to enable consecutive movement along said sets of spaces, second passageway means enabling movement through said second set of spaces by means of said network of routeways running vertically, horizontally and diagonally, each said vertical and horizontal routeway passing through one of said second set of spaces and each said diagonal routeway passing along the borders of four of said second set of spaces.

5. Apparatus as claimed in claim 1, wherein said sets of playing pieces simulate a football type strategy play with two objective endings, one set being an offensive set having pieces using passage along said two sets of spaces and pieces using passage advancement through said second set of spaces by means of said network of routeways, and a defensive set having one type of piece only for moving along the two said sets of spaces, whereby said offensive set utilizes said playing surface with the objective of advancement while said defensive set utilizes said playing surface with the objective of capturing the opposing set.

6. Apparatus as claimed in claim 1, wherein said first set of spaces comprising 45 circles arranged in 7 non touching rows and columns with 5 circles being located in the first and seventh row and 7 circles in each of the remaining rows, said second set of spaces comprising 64 diamond shaped figures located between said rows and columns of circles where 2 of said diamond shaped figures are located between the 3 innermost circles of said first and seventh row and 6 diamond shaped figures located between the 7 circles of the 5 remaining rows and 6 of said diamond shaped figures located between the 7 circles of the 5 innermost columns, said network of routeways comprising lines connecting said 45 circles to each other horizontally, vertically and diagonally, each said vertical routeway divides in half said diamond shaped figure located between said rows of circles so as to enable passage through said figure, each of said horizontally routeway divides in half said diamond shaped figure located between the said columns of circles so as to enable passage through said figures, said diagonal routeways crisscross each other perpendicularly and pass through the outermost borders of four of said diamond shaped figures located diagonally between said columns of circles so as to enable passage through said bordering figures, each of said diamond shaped figure located between said rows or circles having said central resting area means divided in half with one of said secondary resting area means to the left and one said secondary resting area means to the right of said vertical routeway and each said diamond shaped figure located between the said columns of circles having said central resting area means divided in half with one of said secondary resting area means to the top and one of said secondary resting area means to the bottom of said horizontal routeway.

* * * * *